United States Patent [19]

Fehlmann et al.

[11] Patent Number: 4,732,546

[45] Date of Patent: Mar. 22, 1988

[54] ADJUSTING DEVICE FOR A FUEL INJECTION PUMP

[75] Inventors: Wolfgang Fehlmann; Dieter Junger, both of Stuttgart, Fed. Rep. of Germany

[73] Assignee: Robert Bosch GmbH, Stuttgart, Fed. Rep. of Germany

[21] Appl. No.: 5,797

[22] Filed: Jan. 21, 1987

[30] Foreign Application Priority Data

Mar. 25, 1986 [DE] Fed. Rep. of Germany ..... 3609995

[51] Int. Cl.[4] ..... I04B 49/00; F02M 37/04; H01R 4/00

[52] U.S. Cl. ..... 417/289; 123/357; 123/500; 439/271

[58] Field of Search ..... 417/289; 123/357, 500; 339/94 A, 94 M, 94 R, 126 RS

[56] References Cited

U.S. PATENT DOCUMENTS

| | | | |
|---|---|---|---|
| 3,630,643 | 12/1971 | Eheim | 417/289 |
| 3,711,815 | 1/1973 | Pierce | 339/94 M |
| 3,736,548 | 5/1973 | Double | 339/94 A |
| 4,380,221 | 4/1983 | Eheim | 123/343 |
| 4,465,044 | 8/1984 | Yasuhara | 123/357 |
| 4,593,962 | 6/1986 | Knorreck | 339/94 M |
| 4,626,721 | 12/1986 | Ouchi | 339/94 R |
| 4,653,835 | 3/1987 | Schulte | 339/94 A |

FOREIGN PATENT DOCUMENTS

| | | | |
|---|---|---|---|
| 3148596 | 7/1983 | Fed. Rep. of Germany . | |
| 48104 | 4/1981 | Japan | 123/357 |

*Primary Examiner*—William L. Freeh
*Attorney, Agent, or Firm*—Edwin E. Greigg

[57] ABSTRACT

An adjusting device for a fuel injection pump having a plug connection for connection with a control unit. In order to attain sealing off of the plug connection in the vicinity of its passageway through a cap of the housing, the plug connection is connected to a substrate secured in the housing, which substrate has a bushing-like extension passing sealingly through an opening in the cap, and contact pins and conductors are embedded in the substrate.

5 Claims, 2 Drawing Figures

ADJUSTING DEVICE FOR A FUEL INJECTION PUMP

BACKGROUND OF THE INVENTION

The invention is based on an adjusting device for a fuel injection pump. From German Offenlegungsschrift No. 30 04 035 and German Offenlegungsschrift No. 31 48 596, electrical adjusting devices of this kind are already known, in which the plug connection for the control current lead is secured to the cap, and resilient contact elements are provided on the holder which are bonded to conductors leading to the plug connection. In these devices, bonding during the housing assembly is difficult and expensive. The sealing of the housing, which contains fuel, in the vicinity of the plug connection is also problematic.

OBJECT AND SUMMARY OF THE INVENTION

The adjusting device has the advantage that later bonding of the leads between the plug connection on the cap and the holder in the lower part of the housing is dispensed with, as is an insulation of the bridge connections and the contact points. The housing is also closed in a dirt-tight manner even when the counterpart plug has been pulled out. Firmly attaching the plug connection to the substrate also reduces the expense of assembly while securing the conductor connection.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
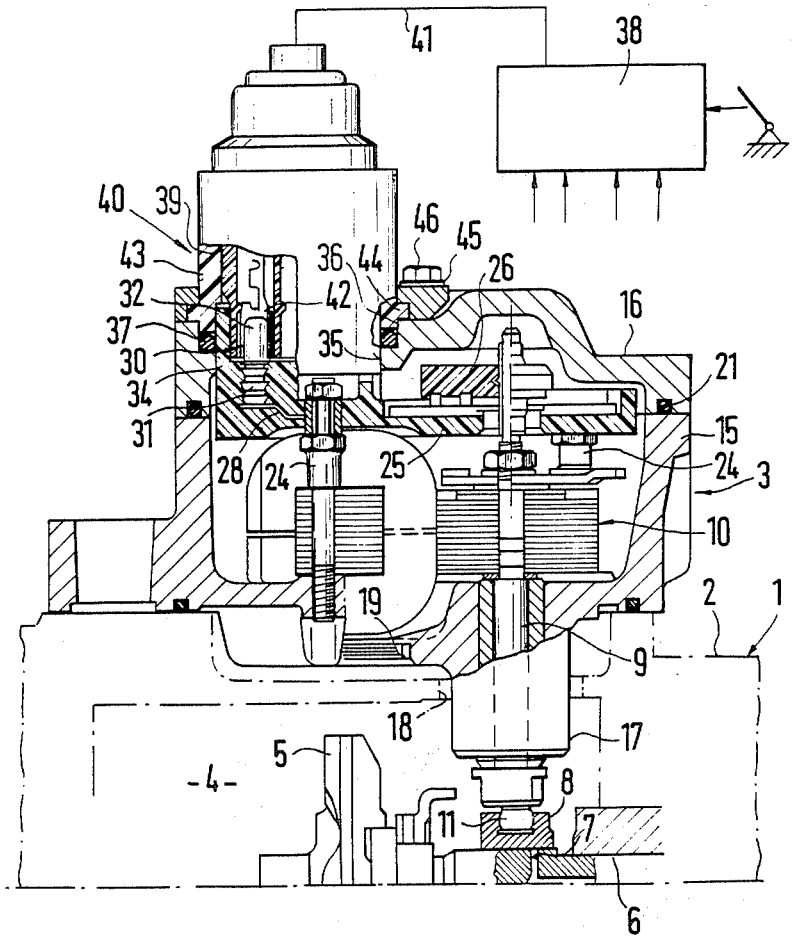
FIG. 1 is a longitudinal partial section on various planes of an adjusting device on a fuel injection pump.

FIG. 1 shows part of a fuel injection pump 1 of the distributor type, on the pump housing 2 of which an adjusting device 3 for fuel quantity adjustment is secured. The pump housing 2 includes a suction chamber 4, in which a cam disk 5, driven by means not shown in detail, effects both reciprocating and rotary motion of a pump piston 6, so as to supply fuel to injection valves of an internal combustion engine. The pump piston 6 has a control bore 7, which can be covered by an annular slide 8, so that upon relative motion of the annular slide 8 with respect to the pump piston 6, a regulation of the quantity of the injection pump takes place in a manner known per se. The annular slide 8 is adjustable in accordance with the rotation of a shaft 9 of a rotary magnet control element 10 of the adjusting device 3 via a coupling crank 11, in a manner also known per se.

Figure 2:
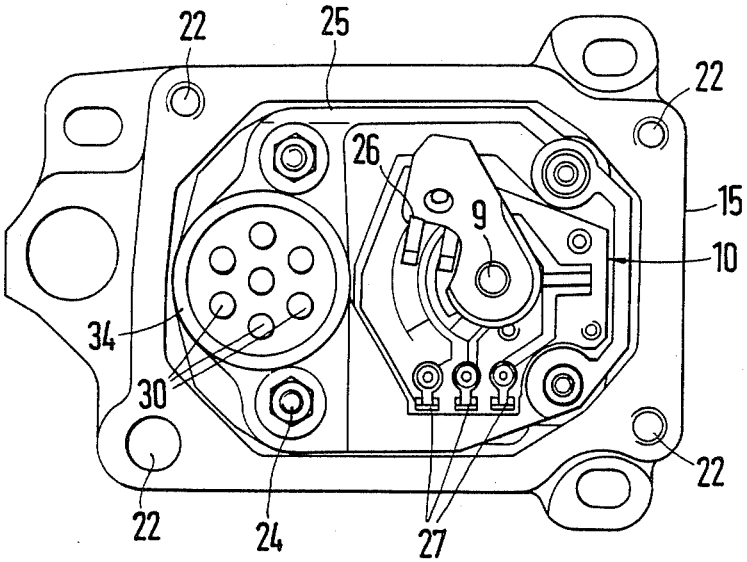
FIG. 2 shows the adjusting device of FIG. 1 in a plan view, with the cap taken off.

The rotary magnet control element 10 sits in a housing comprising a lower part 15 and a cap 16, the lower part 15 being tightly secured on the pump housing 2, the shaft 9 and a bearing eye 17 on the lower part 15 guides the shaft protruding through an opening 18 in the pump housing 2 into the suction chamber 4. Through an opening 19 in the lower part 15 and the opening 18, the interior of the housing of the adjusting device 3 communicates with the suction chamber 4, so that it too is filled with fuel and the same pressure prevails in the interior of the housing as in the suction chamber 4. The cap 16 rests, sealed off by a sealing ring 21, on the upper opening rim of the lower part 15 and is secured to the lower 15 by four screws 22 shown in FIG. 2. The rotary magnet control element 10 is screwed firmly in the lower part 15 with a plurality of stay bolts 24, for example four in number, and these bolts also support a substrate 25 that extends above the rotary magnet control element 10 in the region of transition from the lower part 15 to the cap 16. A potentiometer angle transducer 26 and connection terminals 27 are disposed on the substrate 25 shown in FIG. 2. The resistor layer and contact path of the potentiometer angle transducer 26, as well as the connection terminals 27, are connected to conductors 28, only one of which is shown in FIG. 1, extending embedded in the substrate 25. The ends of the conductors 28 remote from the connection terminals 27 and from the angle transducer 26 terminate, uniformly distributed, on a circle, with one of them terminating in the middle of the circle. The lower end 31 of contact pins 30 is welded or riveted to the conductor ends 28. The contact pins 30 protrude upward from the top of the substrate 25. Their lower end 31 is anchored in the substrate 25, which is thickened in this region. Like the ends of the conductors 28, the contact pins 30 are uniformly distributed on a circle, and one of them is disposed in the center of this circle see FIG. 2. The free ends 32 of the contact pins 30 are surrounded by a bushing 34 of circular-annular cross section, which is embodied as an integral extension on the substrate 25. The substrate 25 and bushing 34 comprise an electrically insulating plastic, such as polyamide, and is manufactured by injection molding. The lower ends 31 of the contact pins 30 that are connected to the ends of conductors 28 are surrounded during the injection molding of the substrate 25 by the material making it up and after that are retained in the correct position by this material.

The bushing 34 protruding upward from the substrate 25 passes through an opening 35 in the cap 16 with a tight fit. Because of this tight fit, the bushing 34 determine the position of the cap 16 on the lower part 15. An axial annular groove 36 is machined into the upper part of the opening 35 and a sealing ring 37 is set into this groove. For electrical connection of the rotary magnet control element 10 with a control unit 38, via the plug connection comprising the contact pins 30 and the bushing 34 on the substrate 25, a counterpart plug 40 is provided on a connecting line 41 that originates at the control unit 38. The counterpart plug 40 has an inner insulating body 39 with contact sleeves 42, which are arranged in mirror symmetry with the contact pins 30 of the plug connection, and a sleeve 43 the lower end of which has an annular cross section that corresponds to that of the annular groove 36 in the cap 16. In the mounted plugged-in state, the lower end of the sleeve 43 surrounds and grips the end of the bushing protruding beyond the top of the cap 16, and with its end face encloses the sealing ring 37 in the annular groove 36.

For retention of the counterpart plug 40, its sleeve 43 has a collar 44, the underside of which rests on the top of the cap 16 and is held by a coupling ring 45, which is secured with screws 46 to the cap 16. When the counterpart plug 40 is mounted and plugged-in, the free end of the sleeve 43 penetrates into the annular groove 36 of the cap and comes to rest on the sealing ring 37. During the ensuing clamping with the coupling ring 45, the end face of the sleeve 43 presses the sealing ring 37, which is thereupon radially deformed and rests with tension against the outer circumference of the bushing 34 and the inner circumference of the annular groove 37. As a result, the passageway of the plug connection through the cap 16 is sealed off in a fluid-tight manner.

Because of the embedding of the conductors 28 and the contact pins 30 in the substrate 25 and because the bushing 34, which surrounds the pins 30, is integrally molded to the substrate 25, a simple, time-saving assembly of the adjusting device 3 is also attained. Furthermore, because of the tight fit between the bushing 34 and the opening 35 in the cap 16, the interior of the housing of the adjusting device is sealed off in a dirt-tight manner.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An adjusting device for controlling an annular slide (8) relative to a control bore (7) of a pump piston (6) in a fuel injection pump having a fluid-tight housing, said housing comprising a lower part (15) and a cap (16), an electric control motor (10) firmly disposed in the lower part of said housing, a molded substrate secured in the lower part of said housing, said substrate (25) comprises an electrically insulating material, conductors (28) embedded in said substrate for connection of control elements which are connected to said control motor for controlling said control motor, a plug connection in an opening (35) of the cap said plug connection including elements (30) having ends (31) in pressure contact with the ends of said conductors (28) in said substrate with ends (32) of the connection elements protruding from said substrate away from said conductors (28), said plug connection is firmly connected to the substrate (25) which has an extension (34) protruding from the substrate and integrally secured thereto, said extension (34) passes through an opening in said cap (16) with a tight fit and in a sealed manner.

2. An adjusting device as defined by claim 1, in which said ends (32) of said plug connection elements (30) that protrude from the substrate (25) are surrounded freely by said extension (34), which takes the form of a bushing including a free end which forms a guide for a counterpart plug (40).

3. An adjusting device as defined by claim 2, in which said free end of the extension (34) is surrounded by an annular groove (36) in the cap (16) in which said annular groove (36) receives a sealing ring (37).

4. An adjusting device as defined by claim 3, in which said annular groove (36) extends axially in said cap (16), and that a free end of said counterpart plug (40) protrudes into said groove which keeps said sealing ring (37) under tension.

5. An adjusting device as defined by claim 4, in which said counterpart plug (40) has a collar (44) near its free end, and said collar (44) is pressed against said cap (16) by a coupling ring (45).

* * * * *